US006692307B2

(12) United States Patent
Laes

(10) Patent No.: US 6,692,307 B2
(45) Date of Patent: Feb. 17, 2004

(54) MODULAR PLUG AND METHOD OF COUPLING A CABLE TO THE SAME

(75) Inventor: Robert Laes, Duffel (BE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 09/969,578

(22) Filed: Oct. 4, 2001

(65) Prior Publication Data

US 2002/0042219 A1 Apr. 11, 2002

(30) Foreign Application Priority Data

Oct. 5, 2000 (EP) ..... 00402750

(51) Int. Cl.[7] ..... H01R 24/00
(52) U.S. Cl. ..... 439/676
(58) Field of Search ..... 439/676, 495, 439/670, 930, 450, 942, 456, 459, 460, 941

(56) References Cited

U.S. PATENT DOCUMENTS

| | | | | |
|---|---|---|---|---|
| 3,189,864 A | | 6/1965 | Angele et al. | |
| 4,195,898 A | | 4/1980 | Chow et al. | |
| 4,267,542 A | | 5/1981 | Weiner | |
| 5,176,535 A | | 1/1993 | Redmond et al. | |
| 5,564,951 A | | 10/1996 | Attal et al. | |
| 6,010,369 A | | 1/2000 | Itabashi et al. | |
| 6,010,371 A | | 1/2000 | Farley et al. | |
| 6,123,572 A | * | 9/2000 | Ishii et al. | 439/465 |

FOREIGN PATENT DOCUMENTS

| | | |
|---|---|---|
| DE | 1 440 183 | 1/1969 |
| EP | 0 716 477 A2 | 6/1996 |
| GB | 2 325 793 A | 12/1998 |

* cited by examiner

*Primary Examiner*—Son V. Nguyen
(74) *Attorney, Agent, or Firm*—Sughrue Mion, PLLC

(57) ABSTRACT

A modular telecommunication plug and a method of coupling a cable with twisted wire pairs to the same. The plug comprises a housing with a wire receivable cavity (1) adapted for guiding bared untwisted ends of the cable wires towards a plug contact end which is provided with grooves (5). The grooves are adapted for receiving straightened bared ends (8) of the wires that will constitute the contact terminals of the plug. In a preferred embodiment, the housing has a fixed part (9) and a removable part (10). The fixed part has the upper wall (3) of the plug housing cavity (1) and the removable part has the lower wall (2) of this cavity, the untwisted wire ends being maintained between these two walls.

12 Claims, 3 Drawing Sheets

MODULAR PLUG AND METHOD OF COUPLING A CABLE TO THE SAME

BACKGROUND OF THE INVENTION

The present invention relates to a modular plug for a cable having a plurality of wires, the plug comprising a housing with a wire receivable cavity adapted for guiding ends of the cable wires towards a contact end of said modular plug.

Such a modular plug is generally known in the art, it is for instance a standardized RJ45 [Registered Jack] data transmission plug widely used in telecommunications and data interconnection systems. A common problem with this kind of plug is to satisfy always-increasing data transmission speeds, while maintaining production costs as low as possible. To this end, and in order to achieve data transmission rates required by certain standard values desired in many applications (e.g. Category 6, Category 7, in LAN (Local Area Networks)), the design of the modular plug is constantly improved. One of these improvements is for instance described in the European Patent Application EP-A2-0 716 477 by Bofill et al, and entitled "*Modular plug for high speed data transmission*". Therein, a wire holder is provided for being inserted in a cavity of the plug. The wire holder is used for arranging and holding the wires of twisted pairs in a predetermined order and to bring, when inserted in the plug, the ends of the wires in a position proximate to a zone of contact where plug contacts can be connected to the wires. The plug contacts are provided with insulation piercing parts that are pressed to pierce through the insulation or the wires in order to contact the conducting strands thereof.

In this known plug, the wires of the pairs are maintained twisted in the wire holder and the length of the straightened or untwisted wire ends is as short as possible. The object thereof is to minimize the well-known cross talk effect caused by electromagnetic interferences between the conductors. However, the insulation piercing parts are relatively large parallel plates facing each other, thereby creating unwanted high capacitive effects that negatively affect the quality of the connector.

On the other hand, in order to remain advantageous in comparison to any other data connector for transmission of high-speed data, the modular plug needs to be produced at relatively low cost.

In order to reduce the number of components and thus the cost of electrical connectors for medical instrumentation, documents U.S. Pat. Nos. 6,010,371 and 5,564,951 both describe an electrical connector having a plurality of wires, and comprising a housing with a cavity adapted for guiding the ends of cable wires towards a contact end of the connector. The contact end of the connector is provided with a plurality of grooves adapted for receiving the bared ends of the wires, portions of these bared ends forming contact terminals of the conductor.

The problem with this type of connectors is that it is not adapted for very high bit rate transmission. Indeed, for connectors to be used in very high bit rate applications, it is of the utmost importance to avoid capacitive effect between adjacent contact terminals. In the connectors of the type mentioned above, the parts of the wires which are parallel to each other are quite long, which increases the capacitive effect between the ends of adjacent wires and is thus detrimental to the transmission characteristics of the connector at very high bit rates. This is because the contact portion of the bared wires forms an angle of about 180° with the portion of the wire that enters the housing.

In addition, it is necessary to have a complex molding of the housing in order to receive the contact portion that is rotated 180° with respect to the portion of the bared wire that enters the housing.

SUMMARY OF THE INVENTION

An object of the present invention is to provide a modular plug of the known type but whereof the production cost is dramatically low while being adapted to achieve a connection to a cable for use in high-speed data transmission applications with reduced cross talk.

According to the invention, this object is achieved due to the fact that the contact end of said modular plug is provided with a plurality of grooves adapted for receiving bared ends of said wires, portions of said bared ends forming contact terminals of said modular plug, the angle between each of said portions forming a contact terminal and the portion of said bared end that is located between the portion forming a contact terminal and the insulated part of the wire is less than 90°.

In this way, the portions of the bared wire ends of the cable that define directly the contact terminals of the modular plug do not have an excessive length in parallel so that the capacitive effect is much more limited than with the prior art.

Besides, the present plug is easier to manufacture than the ones of the prior art.

In addition, the contact can be made directly at the contact end of the modular plug.

At last, the plug of the invention is cost-effective because there is no wire holder required, nor plug contact with insulation piercing parts. The removal of the plug contacts not only reduces dramatically the production cost of the modular plug, but also reduces the cross talk effect. Indeed, the plug contacts comprising the insulation piercing parts and constituted by relatively large metallic plates facing each other with a close spacing, resulting in large capacitors, are no longer present.

Moreover, since the wire receivable cavity is only used for guiding the ends of the wires towards the contact end of the plug, the length of this cavity may be reduced to a minimal value to reduce even more the unwanted cross talk effect.

According to an additional feature of the invention, the angle between the portion of said bared end located between the portion forming a contact terminal and the insulated part of the wire, and said insulated part of the wire, is less than 90°.

In a preferred embodiment of the present invention, said housing has a fixed part and a removable part, said fixed part having a first wall of the plug housing cavity and said removable part having a second wall, opposite to said first wall, of said plug housing cavity, said first and second walls being adapted to cooperate for holding the wire ends into said plug housing cavity.

In this way, the ends of the cable may be prepared to fit exactly into the modular plug and to be positioned into the fixed part of the plug prior to mount the removable part there over. This is preferable than inserting by sliding the several straightened wire ends into the wire receivable cavity and then pushing these ends into the grooves while watching that the correct wire order is maintained.

Another characterizing embodiment of the present invention is that said housing is further provided with a plurality of blind holes substantially orthogonal to said grooves, said holes being located at ends of the grooves and being adapted for receiving tips of the bared wire ends.

The bared wire ends are so maintained with a tight fit in the grooves between the plug housing cavity and the blind holes. By holding the tips of the wires in the holes, these wires are prevented to move within the grooves and the quality of the contact terminals created thereby is increased.

Also another characterizing embodiment of the present invention is that each wire of the cable is an insulated single conductor wire.

Single conductor wires are preferred over braided multi-conductor wires because of their rigidity used to constitute contact terminals.

Another object of the present invention is to provide a cost effective method of coupling a cable, e.g. with twisted wire pairs, to a modular plug according to the invention in order to provide an arrangement having a relatively low cross talk effect and thus usable in high speed applications.

According to the invention, this other object is achieved due to the fact that said method comprises steps of:

- arranging the ends of the wires of the cable in a single plane;
- baring and straightening the ends of the wires over a predetermined length;
- positioning the wire ends in a wire receivable cavity of a housing of said modular plug; and
- positioning the bared wire ends in wire receiving grooves located at a contact end of said modular plug, portions of said bared wire ends forming so contact terminals of said modular plug.

By using bared end of the wires of the cable as contact terminals rather than the classical metallic plug contacts, the arrangement is relatively economic to produce. Furthermore, the cross talk effect resulting from the close juxtaposition of large metallic plates constituting the known plug contacts is removed.

In a preferred embodiment of the present invention, the housing of said modular plug has a fixed part and a removable part, and said method comprises further steps of:

- positioning the wire ends against a first wall of said fixed part of the modular plug;
- positioning the bared wire ends with a tight fit into said wire receiving grooves so that longitudinal portions of the bared wire ends extend outside said grooves to form contact terminals of said modular plug; and
- mounting said removable part onto said fixed part of the modular plug so that a second wall provided by said removable part is positioned against said wire ends in order to hold said wire ends into a wire receivable cavity delimited by said first and said second walls.

In this way, the wire ends may be prepared to fit exactly into the fixed part of the modular plug, with the bared portion fitting into the grooves. The next and final step is then to mount the removable part over the positioned wires. This is easier than inserting the many wire ends into the wire receivable cavity and then pushing the straightened wire ends into the grooves.

Another characterizing embodiment of the present invention is that said method further comprises steps of:

- upwards bending the tips of the bared wire ends orthogonally to said wire receiving grooves; and
- engaging said tips into holes provided at ends of said grooves.

By holding the wire tips in the holes, the bared wire ends are prevented to move within the grooves and the quality of the contact terminals is increased.

It is to be noted that the present method of coupling a cable to a modular plug perfectly suits to the above modular plug of the invention.

Further characterizing embodiments of the present modular plug and method are mentioned in the appended claims.

It is to be noticed that the term 'comprising', used in the claims, should not be interpreted as being limitative to the means listed thereafter. Thus, the scope of the expression 'a device comprising means A and B' should not be limited to devices consisting only of components A and B. It means that with respect to the present invention, the only relevant components of the device are A and B.

BRIEF DESCRIPTION OF THE DRAWINGS

The above and other objects and features of the invention will become more apparent and the invention itself will be best understood by referring to the following description of an embodiment taken in conjunction with the accompanying drawings wherein.

DETAILED DESCRIPTION OF THE INVENTION

Figure 1:
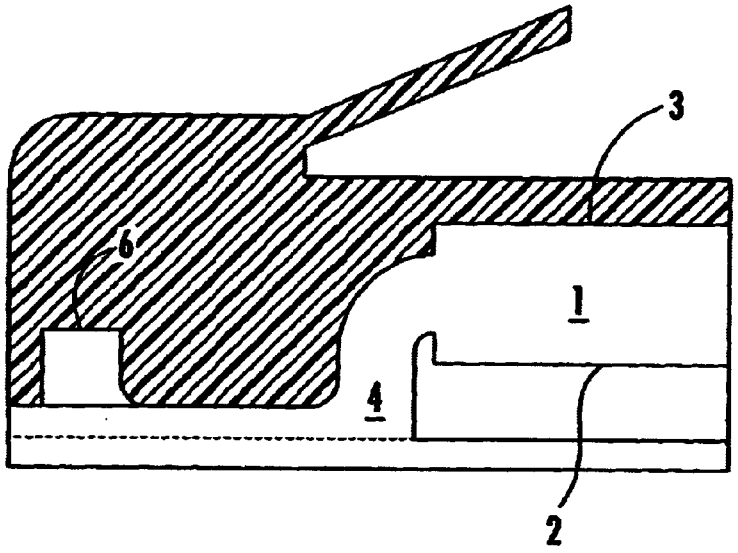
FIG. 1 represents a longitudinal side view of a cross-section of a modular plug according to a first embodiment of the invention.

The modular plug of which a longitudinal cross-section sided view is represented at FIG. 1 is of the standardized type RJ45 [Registered Jack]. Such a modular plug is widely used in telecommunications and computer interconnection systems for ending cables adapted for the transmission of high speed data. The plug is designed to satisfy the requirements of the Categories 5, 6 and 7 standards and the cables generally, but not necessarily, comprise several twisted pairs of wires. An example thereof is the known UTP [Unshielded Twisted Pair] cable comprising for instance eight wires arranged in four pairs of two twisted wires each. The contacts terminals of the plug, adapted to be engaged within a cooperating receiving jack, are formed by bared portions of the cable or wire conductors themselves, as will become clear from the description below.

Figure 2:
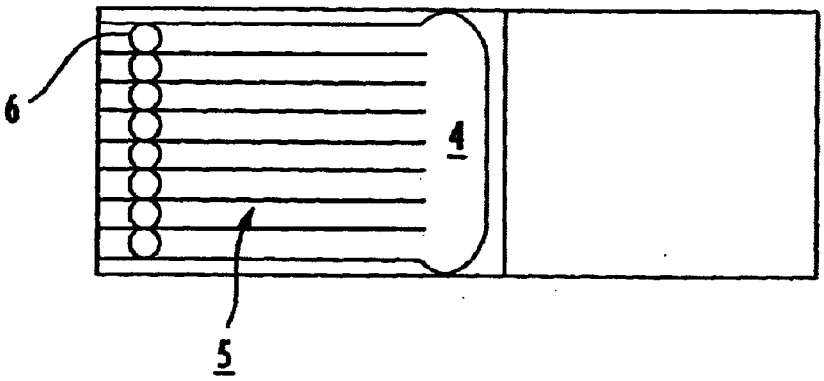
FIG. 2 is a bottom view of the modular plug of FIG. 1.
Figure 3:
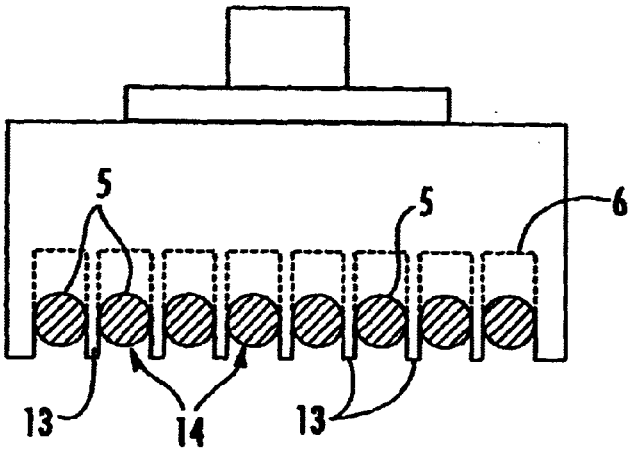
FIG. 3 is a front view of the modular plug of FIG. 1.

The modular plug has a housing with a receivable cavity 1 adapted to receive untwisted ends of the wire pairs of the cable between a lower wall 2 and an upper wall 3. Towards the plug contact terminals, at the bottom left on FIG. 1, the plug housing cavity 1 ends with an opening 4 extending to the bottom part of the plug. As can be seen at FIG. 2, the opening 4 is almost as large as the plug and ends at grooves generally indicated by an arrow 5, separated from each other by walls 13 as shown in FIG. 3 and located on the bottom of the plug. The grooves 5 are parallel to each other and extend from the opening 4 to the front end of the plug at the left of FIGS. 1 and 2. The grooves 5 are adapted to receive bared ends 14 of the wires that will form the contacts of the plug. In the present example of an eight conductor cable, eight grooves are provided at the bottom of the plug. The walls 13 are used to hold the bared ends 14 of the wires in the cavity 1 as well as to guide the contacts of the jack (not shown) during its insertion in the plug.

Near to the front end of the plug, a blind hole, such as 6, is made in each of the grooves. The holes are upward with respect to the FIGS. 1 and 3 and the diameter of these holes is chosen to accommodate the insertion of the bared cable conductor.

Figure 4:
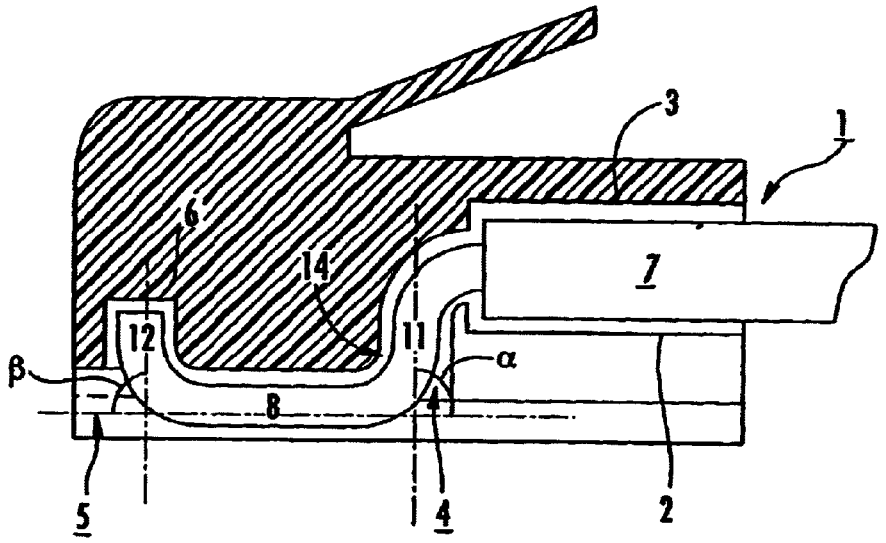
FIG. 4 shows the modular plug of FIG. 1 with a conductive wire placed therein.

A longitudinal cross-section sided view of an assembly comprising the plug and the wires is shown at FIG. 4. In this assembly, the wires of the cable are untwisted and arranged in an horizontal plane prior to be engaged in the plug housing or wire receivable cavity 1. The end of the insulated part of each wire, generally indicated by numeral 7, abuts against the end of the cavity and is maintained between the walls 2 and 3 delimiting the wire receivable cavity 1. The bared ends 14 of the wires 7 are engaged in the opening 4 at the end of the cavity 1 and are so guided between walls 13 towards the bottom grooves 5. Straightened portions 8 of these bared wire ends are then engaged with a tight fit into the grooves 5 and their tips 12 are inserted in the holes 6. The straightened bared portions 8 of the wires are so prevented to move within the grooves 5. These straightened bared portions 8 of the wires form the contact terminals of the plug.

According to the invention, the angle $\alpha$ between the straightened bared portion 8 that forms the contact terminal of the plug and the portion 11 of the bared wire that is located between this straightened bared portion 8 and the insulated part of the wire 7 is less than 90° as illustrated in FIG. 4. This avoids too long parallel lengths of bared wire ends within the plug, that would increase the capacitive effect in the plug. The angle $\alpha$ should be as small as possible and the length of the straightened bared portion 8 as short as possible in order to minimize the length of the bared wires that are in parallel to each other.

In this way, the contact is made directly at the lower wall 2 of the cavity 1, which is the contact end of the modular plug according to the invention.

In addition, the angle $\beta$ between the tip 12 of the bared portion 14 and the straightened bared portion 8 that forms the contact terminal is less than 90°, and preferably as small as possible but sufficient to ensure good retention of the wire tip 12 in the hole 6.

Figure 5:
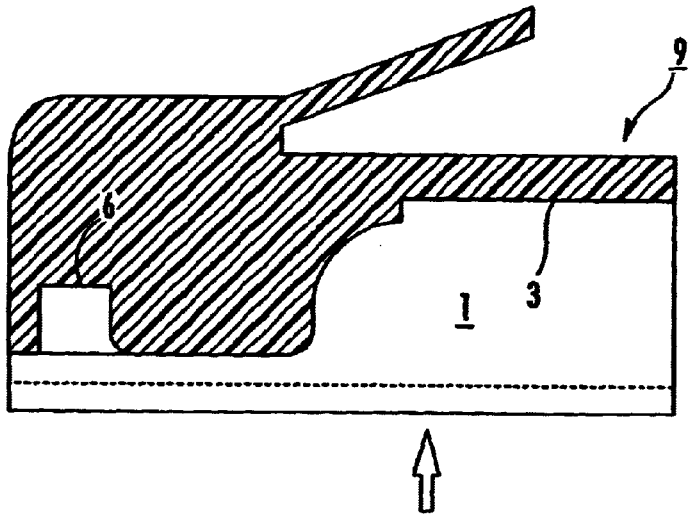
FIG. 5 represents a fixed part of the modular plug of FIG. 1.
Figure 7:
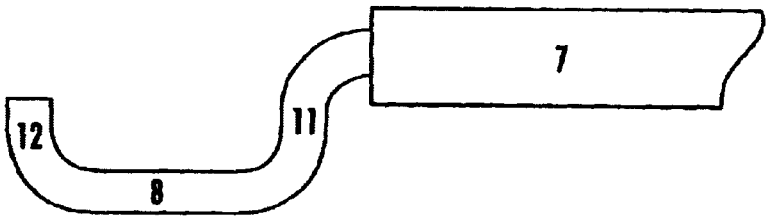
FIG. 7 shows a conductive wire to be placed between the fixed part and the removable part of the modular plug of FIGS. 5 and 6.
Figure 6:
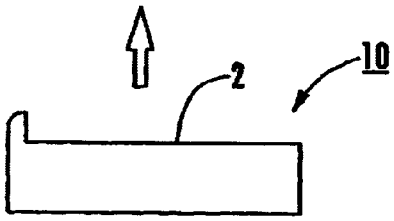
FIG. 6 represents a removable part used to cooperate with the fixed part of FIG. 5.

In a preferred embodiment, shown at the FIGS. 5, 6 and 7, the modular plug is constituted by a fixed part 9 and a removable part 10. The fixed part 9 of the plug, of which a longitudinal cross-section side view is represented at FIG. 5, comprises almost all the items of the plug except the lower wall 2 of the plug housing cavity 1. This lower wall 2 belongs to the removable part 10 of the plug as shown at FIG. 6. Owing to this separated parts, the wires may be pre-formatted to mate the shape of the fixed part 9 of the plug. Such a prepared wire 7 is shown at FIG. 7 with its bared portion having a straightened part 8 adapted to form a contact terminal of the plug. The prepared wires of the cable are then placed into the fixed part 9 of the plug, as indicated by an arrow between the FIGS. 7 and 5, and the wire tips 12 are engaged in the holes 6. The removable part 10 is then afterwards placed onto the fixed part 9, as indicated by an arrow between the FIGS. 6 and 7, in order to maintain the insulated parts of the wires between the walls 3 and 2 as for the plug shown at FIG. 4. This construction with a fixed and a removable part facilitates the assembly of the cable on the plug and improves thereby the production.

Figure 8:
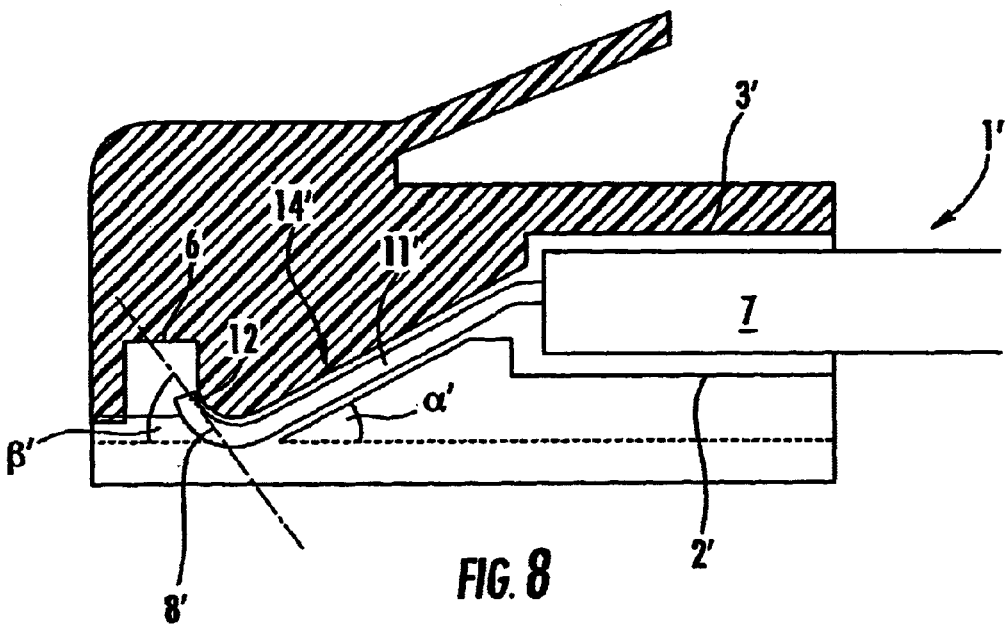
FIG. 8 represents a longitudinal side view of a cross-section of a modular plug according to a second embodiment of the invention.

In another preferred embodiment, shown at FIG. 8 (where corresponding elements are differentiated from the ones of the first embodiment by bearing "primed" reference numerals), the opening 4' of the cavity 1' is such that the portion 8' of the wire that forms the contact terminal of the plug is a curved portion linked to the insulated part of the wire 7 by a straightened portion 11'; according to the invention, the angle $\alpha'$ between the straightened portion 11' and the curved portion 8' is 45° or less, and at least less than 90° while the straightened bare portion 11' is as short as possible for the same reasons as mentioned above. Besides, the angle $\beta'$ between the tip 12 of the bared portion 14' and the straightened bared portion 11' that forms the contact terminal is less than 90°, and preferably as small as possible but sufficient to ensure good retention of the wire tip 12 in the hole 6 whose position is adapted accordingly. The rest of the modular plug of FIG. 8 is unchanged in its principle with respect to the one of FIGS. 1 to 7. In other words, it may also be constituted by a fixed part and a removable part that comprises the lower wall 2' of the plug.

Instead of having a two-part modular plug as shown in the embodiments of FIGS. 1 to 8 above, it is possible to use a single plastic piece for the modular plug, directly over molded on the wires. In such a design, the wires are stripped and preformed as in the other embodiments, and precisely held in place in parallel in the injection mold, e.g. by locating holes and pins in the injection mold. Afterwards, the modular plug is over molded. Such a method of manufacture leads to a minimal number of manufacturing steps and is thus very easy to implement.

It is to be noted that each wire preferably has a single conductor rather than braided multi-conductors because of the rigidity needed to form the straightened contact terminals of the plug.

It is also to be noted that the plug contacts, which are thus directly made by the cable wires, may be metallised, coated and/or plated in any known manner in order to achieve better electrical contact requirements and proper low-resistance contact during the plug's lifetime.

While the principles of the invention have been described above in connection with specific apparatus, it is to be clearly understood that this description is made only by way of example and not as a limitation on the scope of the invention, as defined in the appended claims.

For instance, the plug of the invention may be adapted to receive a cable having a plurality of pairs of twisted wires or a cable having a plurality of parallel or substantially parallel wires (either in a plane or free in a sheath).

What is claimed is:

1. A modular plug for a cable having a plurality of wires, the plug comprising:

a housing with a wire receivable cavity adapted for guiding bared ends of cable wires towards a contact end of said modular plug, the contact end of said modular plug being provided with a plurality of grooves adapted for receiving the bared ends of said cable wires, said grooves configured to prevent the wires from moving within the grooves and, at least a portion of said cable wires forming straight and flat contact terminals of said modular plug, said straight and flat contact terminals being positioned such that the straight and flat portion of said cable wire does not face the insulated part of the wire wherein, the angle between portions of said cable wires forming said contact terminal and a portion of said bared end that is located between said portion forming a contact terminal and an insulated part of the wire is less than 90°.

2. The modular plug according to claim 1, wherein an angle between a tip of a bared portion and a portion of said bared end that is located between said portion forming a contact terminal and the insulated part of the wire is less than 90°.

3. The modular plug according to claim 1, wherein said housing has a fixed part and a removable part, said fixed part having a first wall of the plug housing cavity and said removable part having a second wall, opposite to said first wall of said plug housing cavity, said first and second walls being adapted to cooperate for holding the bared ends of the wire cables into said plug housing cavity.

4. The modular plug according to claim 1, wherein said housing is further provided with a plurality of blind holes substantially orthogonal to said grooves, said holes being located at ends of the grooves and adapted for receiving the bared ends of the wire cables.

5. The modular plug according to claim 1, wherein each wire of the cable is an insulated single conductor wire.

6. The modular plug according to claim 1, wherein the plurality of grooves are parallel and adapted for positioning the cable wires forming the straightened portions extending from said plug housing cavity until said blind holes.

7. A method of coupling a cable to a modular plug said method comprises:

arranging a cable wire in a single plane;

baring and straightening a portion of the cable wire over a predetermined length;

positioning bared and untwisted wire ends in a wire receivable cavity of a housing of said modular plug; and positioning the bared wire ends in wire receiving grooves located at a contact end of said modular plug, said receiving grooves configured to prevent bared wire ends from moving within the receiving grooves, and portions of said cable wire forming contact terminals of said modular plug, wherein said straight and flat contact terminals are positioned such that the straight and flat portion of said cable wire does not face the insulated part of the wire.

8. The method according to claim 7, wherein the housing of said modular plug has a fixed part and a removable part, and in that said method further comprises:

positioning the cable wire against a first wall of said fixed part of the modular plug;

positioning the bared wire ends with a tight fit into said wire receiving grooves so that longitudinal portions of the cable wire extend outside said receiving grooves to form contact terminals of said modular plug; and mounting said removable part onto said fixed part of the modular plug so that a second wall provided by said removable part is positioned against said untwisted wire ends in order to hold said bared wire ends into a wire receivable cavity delimited by said first and second walls.

9. The method according to claim 7, wherein said method further comprises:

bending upward tips of the bared wire ends orthogonally to said wire receiving grooves; and engaging said tips of said bared wire ends into holes provided at ends of said receiving grooves.

10. The method of coupling a cable to a modular plug according to claim 7, wherein said method further comprises:

arranging cable wire ends in a single plane;

baring and straightening the cable wire ends over a predetermined length; and over molding said modular plug onto said cable wires.

11. The method according to claim 7, wherein the shape of said wire receivable cavity is adapted for guiding the bared wire ends towards a contact end of said modular plug.

12. A modular plug for a cable having a plurality of wires, the plug comprising:

a housing with a wire receivable cavity adapted for guiding ends of cable wires towards a contact end of said modular plug, the contact end of said modular plug being provided with a plurality of grooves adapted for receiving bared ends of said wires, said grooves configured to prevent the wires from moving within the grooves and at least a portion of said bared ends forming straight and flat contact terminals of said modular plug, wherein said straight and flat contact terminals are positioned such that the straight and flat portion of said cable wire does not face the insulated part of the wire, said contact terminals having a right end and a left end, wherein, a first portion of said bared ends, located between the right end of the contact terminals and an insulated part of the wire, having an angle less than 90°, and a second portion of said bared ends, located between the left end of the contact terminals and a tip of said bared ends, having an angle less than 90°.

* * * * *